US006468136B1

(12) United States Patent
Lum et al.

(10) Patent No.: US 6,468,136 B1
(45) Date of Patent: Oct. 22, 2002

(54) TUNGSTEN CMP WITH IMPROVED ALIGNMENT MARK INTEGRITY, REDUCED EDGE RESIDUE, AND REDUCED RETAINER RING NOTCHING

(75) Inventors: Robert T. Lum; David W. Groechel, both of Sunnyvale; Li Wu, Fremont; Chiu Chan, Foster City, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/606,666

(22) Filed: Jun. 30, 2000

(51) Int. Cl.[7] ..... B24B 1/00
(52) U.S. Cl. ..... 451/41; 451/286; 438/692
(58) Field of Search ..... 451/41, 57, 28, 451/285–289; 438/692–693; 216/88, 89

(56) References Cited

U.S. PATENT DOCUMENTS 4,393,628 A * 7/1983 Ottman et al. ..... 451/285
4,466,218 A * 8/1984 Ottman et al. ..... 451/285
5,899,738 A 5/1999 Wu et al.
6,001,447 A 12/1999 Tanahashi et al.
6,045,435 A * 4/2000 Bajaj et al. ..... 451/41
6,110,021 A * 8/2000 Ota et al. ..... 451/159
6,121,111 A * 9/2000 Jang et al. ..... 438/401
6,251,215 B1 * 6/2001 Zuniga et al. ..... 156/345

* cited by examiner

*Primary Examiner*—George Nguyen
(74) *Attorney, Agent, or Firm*—Moser, Patterson & Sheridan

(57) ABSTRACT

Tungsten CMP is conducted with improved alignment mark integrity and reduced edge residue by employing a retaining ring having a mechanical hardness greater than about 85 durometer and a relatively soft polishing pad. Embodiments of the present invention include conducting CMP employing a carrier comprising a retaining ring additionally having a wear rate during CMP of less than about 1 mil per hour and a polishing pad having a hardness less than about 60 durometer. Suitable retaining ring materials include ceramics, quartz, polymers and fiber reinforced polymers.

21 Claims, 3 Drawing Sheets

TUNGSTEN CMP WITH IMPROVED ALIGNMENT MARK INTEGRITY, REDUCED EDGE RESIDUE, AND REDUCED RETAINER RING NOTCHING

TECHNICAL FIELD

The present invention relates to a method for planarizing substrates by chemical-mechanical polishing (CMP). The present invention is applicable in manufacturing high speed integrated circuits having submicron design features and high conductivity interconnect structures with improved reliability and increased production throughput.

BACKGROUND ART

The escalating requirements for high density performance associated with ultra large scale integration in semiconductor wiring require dramatically increased packing densities of devices on integrated circuits and require the use of high-resolution photography and isotropic plasma etching. In sub-micron technology, the packing density of devices on integrated circuits is strongly dependant upon the integrity of the metal interconnection density. Accordingly, the design rules are increasingly aggressively scaled requiring more levels of metal to effectively interconnect the high density of the devices on the chip.

Conventional semiconductor methodology comprises the formation of stacked vias between the various levels of metal interconnections to achieve high density metal interconnections. It is necessary to form a planar surface due to the need to employ a shallow depth of focus when exposing the photoresist.

Conventional metal plugs in via holes are formed by conformably depositing a metal, such as tungsten (W), completely filling the via holes. The W overburden is then planarized, as by etching back or chemical-mechanical polishing (CMP), to the surface of the insulating layer in which via holes were formed between patterned metal levels, or to the insulating layer in which the contact openings are formed over the devices on the substrate.

In conventional CMP techniques, a wafer carrier assembly is in contact with a polishing pad mounted on a CMP apparatus. The wafers are typically mounted on a carrier or polishing head which provides a controllable pressure urging the wafers against the rotating polishing pad. The pad has a relative movement with respect to the wafer driven by an external driving force. Thus, the CMP apparatus effects polishing or rubbing movement between the surface of each thin semiconductor wafer and the polishing pad while dispersing a polishing slurry containing abrasive particles in a reactive solution to effect both chemical activity and mechanical activity while applying a pressure between the wafer and the polishing pad.

A conventional CMP system is schematically illustrated in FIG. 1 and comprises a wafer carrier 12 which supports wafer 14 against a backing pad 18. Carrier 12 is rotated on a platen 11 to which a polishing pad 17 is attached. A retainer ring 13 is provided to retain the wafer in the carrier so that it does not come off during CMP. A polishing solution can be dispensed through nozzle 15. Additional nozzle 16 can be provided for rinsing with water or other cleaning functions.

A conventional damascene plug filling and CMP technique is dramatically illustrated in FIGS. 2A and 2B, wherein similar reference numerals denote similar features. Adverting to FIG. 2A, a first conductive layer 20 on a partially completed integrated circuit on a substrate (not shown) of, e.g., aluminum, copper or an alloy thereof, is deposited, as by physical vapor deposition (PVD). First conductive layer 20 is then patterned by conventional photolithographic techniques and isotropic plasma etching is conducted to provide a metal interconnection layer for the devices on the substrate. An insulating layer 21, commonly referred to as an interlayer dielectric (ILD), is then deposited over the patterned conductive layer 20. The ILD is typically comprised of silicon oxide and deposited by a low pressure chemical vapor deposition technique. Insulating layer 21 is then planarized, as by CMP.

An opening 22, referred to as a via hole, is then etched in insulating layer 21 to expose the underlying, patterned first conductive layer 20. A barrier layer, e.g., titanium/titanium nitride, also commonly referred to as a glue layer, is conformably deposited over the insulating layer 21 and in the contact opening 22. A metal layer 24, e.g., W, is then deposited on barrier layer 23 and in via hole 22, as by chemical vapor deposition employing tungsten hexafluoride as a gaseous reactant. CMP is then performed to provide a planarized upper surface 25 as shown in FIG. 2B.

There are several disadvantages attendant upon such conventional CMP techniques, particularly when conducting CMP on W, which problems are exacerbated as device geometries plunge into the deep sub-micron range. One such problem encountered is the troublesome filling of alignment marks 31, shown in FIG. 3, formed in insulating layer 30. It was found that during CMP alignment marks 31 become filled with a substance 32 such that the alignment marks are no longer visible during subsequent alignment of the reticle mask employed during exposure of the photoresist in the step-and-repeat tool for patterning the next level of metal.

Another problem stemming front conventional CMP, particularly with W, is schematically illustrated in FIG. 4 wherein residual tungsten 40 remains on the beveled edges of the wafer (substrate) 5 subsequent to CMP. The residual tungsten 40 is vulnerable to peeling and, hence, contaminates the device causing chip defects during subsequent processing.

There exists a need in the semiconductor industry for methodology enabling the planarization of deposited metal to form reliable metal plugs in contacts and vias without interfering with the alignment marks and/or generating a residue on the beveled edges of the wafer substrate.

DISCLOSURE OF THE INVENTION

An aspect of the present invention is a CMP technique for planarizing metals which does not result in obscuring alignment marks or result in generating edge residues, and does not result in wafer coming off the carrier during CMP.

Additional aspects and other features of the present invention will be set forth in part in the description which follows and in part will become apparent to those having ordinary skill in the art upon examination or may be learned from the practice of the present invention. The aspects of the present invention may be realized and obtained as particularly pointed out in the appended claims.

According to the present invention, the foregoing and other aspects are implemented in part by a method of a chemical mechanical polishing (CMP) a substrate surface, the method comprising: mounting the substrate in a carrier comprising a retaining ring, the retaining ring comprising a polymer having a mechanical hardness greater than about 85 durometer; and CMP the substrate surface using a polishing pad having a hardness less than about 60 durometer.

Embodiments of the present invention comprise CMP a substrate surface containing W metalization at a CMP removal rate of at least 3000 Å/min. employing a retaining ring comprising ceramics, quartz, polymer or fiber-reinforced polymer, wherein the substrate surface comprises trench alignment marks extending into the substrate that are free of any substantial amounts of carbon-containing debris subsequent to CMP.

Additional aspects of the present invention will become readily apparent to those skilled in this art from the following detailed description wherein embodiments of the present invention are described, simply by way of illustration of the best mode contemplated for carrying out the present invention. As will be realized, the present invention is capable of other and different embodiments and its several details are capable of modifications in various obvious respects, all without departing from the present invention. Accordingly, the drawings and description are to be regarded as illustrative in nature, and not as restrictive.

DESCRIPTION OF THE INVENTION

Figure 1:
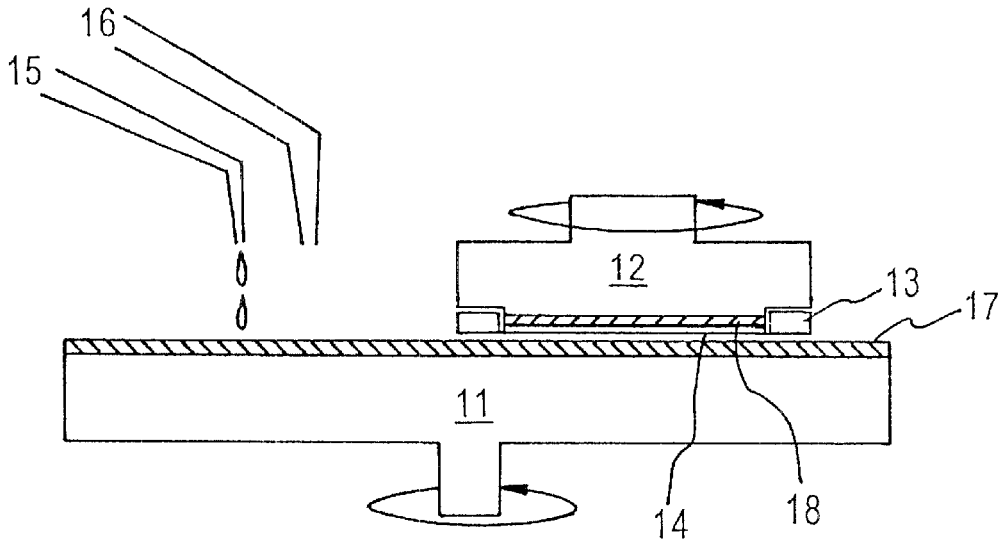
FIG. 1 illustrates a portion of a conventional CMP apparatus.
Figure 2A:
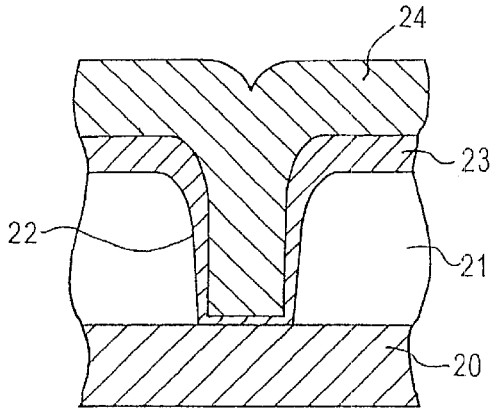
FIGS. 2A and 2B illustrate sequential phases of forming an interconnection.
Figure 2B:
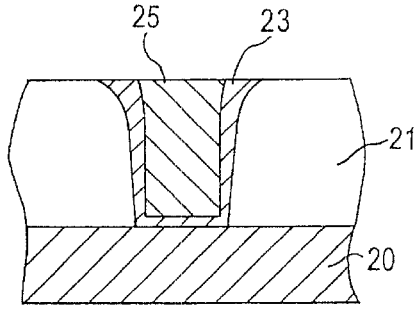
Figure 3:
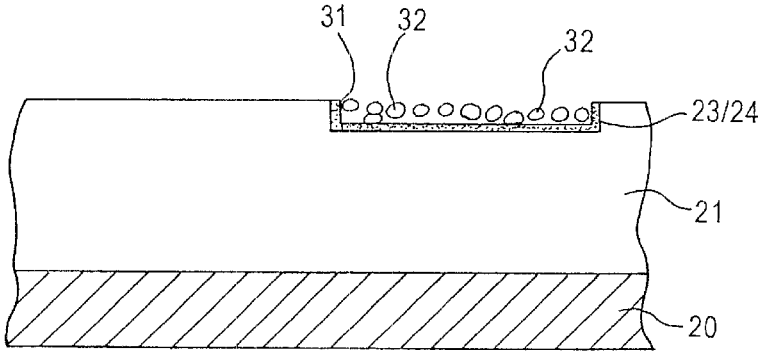
FIG. 3 schematically illustrates the problem of alignment mark contamination.
Figure 4:
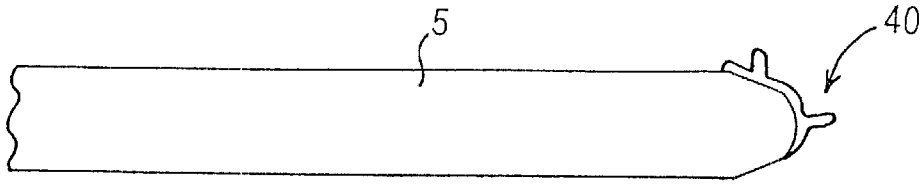
FIG. 4 schematically illustrates the problem of edge residue contamination.

The present invention addresses and solves problems attendant upon conventional CMP methodology, particularly W CMP methodology wherein a damascene opening is filled by W and the overburden subjected to CMP to effect planarization. As a result, alignment mark contamination 32, as illustrated in FIG. 3, and edge residues 40, shown in FIG. 4, result. After extensive experimentation and investigation it was found that the alignment mark contamination comprised carbon-containing residues. Upon further experimentation and investigation, it was concluded that the carbon-containing residues in the alignment mark openings, preventing alignment mark visibility during subsequent photolithographic techniques, stem from an interaction between the retaining ring and polishing pad. Having discovered the source of the alignment mark contamination problem, further experimentation was conducted to determine suitable materials which can be employed for the retaining ring in combination with suitable materials for the polishing pad such that carbon-containing contaminants do not form in the alignment marks to prevent their visibility upon subsequent photolithographic processing.

After experimentation and investigation, it was found that a suitable combination of materials for the retaining ring and polishing pad can be selected based upon certain physical characteristics. For example, it was determined that a relatively abrasion free material can be employed for the retaining ring while employing a relatively soft polishing pad. It was found that such a strategic combination does not generate any substantial amounts of carbon-containing residues in the alignment marks. In fact, it was found that the use of an abrasion resistant material for the retaining rings in combination with a relatively soft polishing pad resulted in virtually no carbon-containing contamination of alignment marks.

Upon further extensive experimentation and investigation, it was found that use of certain abrasion free materials for the retaining ring in combination with a relatively soft polishing pad resulted in "notching" of the retaining ring, thereby impeding the ability of the retainer ring to retain the wafer in the carrier so that it does not come off during CMP. Continued experimentation and investigation led to the discovery that the combination of a relatively hard material for the retaining ring and a relatively soft pad material yielded optimum results. Accordingly, the present invention is based, in part, upon the surprising and unexpected discovery that the use of certain hard abrasion free materials for the retaining ring in combination with a relatively soft polishing pad, resulted in virtually no carbon containing contamination of alignment marks and no "slipping" of the wafer in the carrier during CMP.

Given the guidance of the present disclosure suitable materials for the retaining ring and polishing pad can be selected when conducting CMP for a particular material, e.g., W. It was found, for example, that a suitable material for the retaining ring should exhibit a mechanical hardness greater than about 85 durometer. In various embodiments, suitable materials for the retaining ring may also exhibit a wear rate during CMP of less than about 1 mil per hour, e.g., less than about 0.5 mil per hour, while the material for the polishing pad should exhibit a hardness less than about 60 durometer, e.g., less than about 50 durometer. Suitable materials for the retaining ring include ceramics, quartz, various polymers and fiber-reinforced polymers. Embodiments include utilizing retaining rings comprising a polymer reinforced with carbon or carbon fibers and polymers including polyetheretherketones (PEEK), polyimides (PI), and polybenzimidazoles (PBI). It was found that the proper combination of a retaining ring material having a hardness greater than about 85 durometer and soft polishing pad enabled effective CMP at a removal rate of 3000 Å/min. and faster without any substantial carbon-containing contamination of alignment marks. It was also found that edge residues were reduced as a result of the strategic selection of retaining ring material and soft polishing pad.

Figure 5:
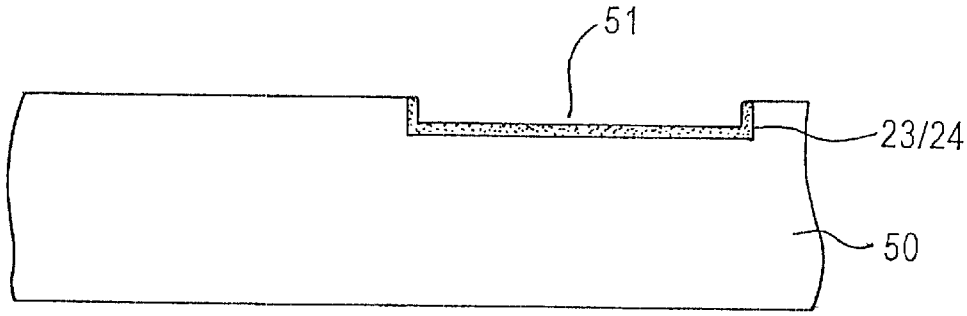
FIG. 5 schematically illustrates an uncontaminated alignment mark achieved by embodiments of the present invention.

Suitable ceramic materials for use as the retaining ring include alumina and zirconia. Suitable polymers include polyetheretherketones (PEEK), polyimides (PI), and polybenzimidazoles (PBI). Another suitable material for the retainer ring is Teflon® reinforced with carbon fibers. A suitable polishing pad for use with the low wear rate retaining rings according to the present invention include Politex and WWP 3000 available from Rodel located in Newark, Del. As a result, alignment mark contamination is avoided, as illustrated in FIG. 5.

The present invention provides methodology enabling CMP of various metals, such as W, without contaminating alignment marks so that they retain visibility for subsequent photolithographic techniques, and with reduced edge deposits. The present invention enjoys industrial utility in various applications, particularly in manufacturing high density semiconductor devices with submicron features.

Only a few implementations of the present invention and but a few examples of its versatility are shown and described in the present disclosure. It is to be understood that the present invention is capable of using various other combinations and environments and is capable of changes and modifications within the scope of the inventive concept as expressed herein.

What is claimed is:

1. A method of chemical mechanical polishing (CMP) a substrate surface, the method comprising:

mounting the substrate in a carrier comprising a retaining ring, the retaining ring comprising a polymer having a mechanical hardness greater than about 85 durometer; and CMP the substrate surface using a polishing pad having a hardness less than about 60 durometer.

2. The method according to claim 1, wherein the polymer is reinforced with carbon or carbon fibers.

3. The method according to claim 2, wherein the substrate surface contains tungsten.

4. The method according to claim 1, wherein the retaining ring comprises a polymer selected from the group consisting of polyetheretherketones (PEEK), polyimides (PI), and polybenzimidazoles (PBI).

5. The method according to claim 1, wherein the retaining ring comprises PEEK.

6. The method according to claim 1, comprising CMP at a removal rate of at least 3000 Å/min.

7. The method according to claim 1, wherein the polishing pad has a hardness less than about 40 durometer.

8. A method of chemical mechanical polishing (CMP) a substrate surface, the method comprising:

mounting the substrate in a carrier comprising a retaining ring, the retaining ring comprising a polymer having a mechanical hardness greater than 85 durometer; and CMP the substrate surface using a polishing pad having a hardness less than about 60 durometer, and wherein the substrate surface comprises trench alignment marks extending into the substrate.

9. The method according to claim 8, wherein the substrate surface contains tungsten.

10. The method according to claim 8, wherein the retaining ring comprises a polymer selected from the group consisting of polyetheretherketones (PEEK), polyimides (PI), and polybenzimidazoles (PBI).

11. The method according to claim 8, wherein the retaining ring comprises PEEK.

12. The method according to claim 8, comprising CMP at a removal rate of at least 3000 Å/min.

13. The method according to claim 8, wherein the polymer is reinforced with carbon or carbon fibers.

14. The method according to claim 8, wherein the polishing pad has a hardness less than about 40 durometer.

15. A method of chemical mechanical polishing (CMP) a substrate surface, the method comprising:

mounting the substrate in a carrier comprising a retaining ring having a wear rate during CMP of less than about 1 mil per hour and a mechanical hardness greater than about 85 durometer; and CMP the substrate surface using a polishing pad having a hardness less than about 60 durometer.

16. The method according to claim 15, wherein the retaining ring has a wear rate less than about 0.5 mil per hour.

17. The method according to claim 15, comprising CMP at a removal rate of at least 4000 Å/min.

18. The method according to claim 15, wherein the retaining ring comprises a material selected from the group consisting of ceramics, quartz, polymers and fiber-reinforced polymers.

19. The method according to claim 15, wherein the polishing pad has a hardness less than about 40 durometer.

20. A method of chemical mechanical polishing (CMP) a surface of a substrate having trench alignment marks extending into the substrate, the method comprising:

mounting the substrate in a carrier comprising a retaining ring having a wear rate during CMP of less than about 1 mil per hour and a mechanical hardness greater than about 85 durometer; and CMP the substrate surface using a polishing pad having a hardness less than about 60 durometer such that the alignment marks do not contain any substantial amount of carbon-containing debris after CMP.

21. A method of chemical mechanical polishing (CMP) a surface of a substrate containing tungsten and having trench alignment marks extending into the substrate, the method comprising:

mounting the substrate in a carrier comprising a retaining ring having a wear rate during CMP of less than about 1 mil per hour and a mechanical hardness greater than about 85 durometer; and CMP the substrate surface using a polishing pad having a hardness less than about 60 durometer such that the alignment marks do not contain any substantial amount of carbon-containing debris after CMP.

* * * * *

UNITED STATES PATENT AND TRADEMARK OFFICE

CERTIFICATE OF CORRECTION

PATENT NO. : 6,468,136 B1
DATED : October 22, 2002
INVENTOR(S) : Robert T. Lum et al.

It is certified that error appears in the above-identified patent and that said Letters Patent is hereby corrected as shown below:

Column 2,
Line 35, please change "front" to -- from --.

Signed and Sealed this

Fourth Day of March, 2003

JAMES E. ROGAN
*Director of the United States Patent and Trademark Office*